US006760564B2

(12) United States Patent
Oohara et al.

(10) Patent No.: US 6,760,564 B2
(45) Date of Patent: Jul. 6, 2004

(54) PICTURE IMAGE FORMING APPARATUS WITH INTERMEDIATE TRANSFER BELT TRAINED AROUND TWO ROLLERS OF DIFFERENT DIAMETER

(75) Inventors: Shunichi Oohara, Ushiku (JP); Kazuhiro Wakamatsu, Hitachi (JP); Akira Sasaki, Hitachi (JP); Kazuo Kikuchi, Hitachi (JP); Masahiko Saito, Kitaibaraki (JP); Atsushi Onose, Hitachinaka (JP); Akira Shimada, Hitachi (JP); Masashi Yamamoto, Hitachi (JP); Masaru Nakano, Tsukuba (JP); Shogo Matsumoto, Ushiku (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/238,870

(22) Filed: Sep. 11, 2002

(65) Prior Publication Data

US 2003/0063929 A1 Apr. 3, 2003

(30) Foreign Application Priority Data

Sep. 28, 2001 (JP) ..... 2001-301251

(51) Int. Cl.[7] ..... G03G 15/01

(52) U.S. Cl. ..... 399/302; 399/121

(58) Field of Search ..... 399/121, 162, 399/167, 297, 302, 308

(56) References Cited

U.S. PATENT DOCUMENTS 5,040,028 A * 8/1991 Kamimura et al. ..... 399/302

* cited by examiner

*Primary Examiner*—Hoang Ngo
(74) *Attorney, Agent, or Firm*—Antonelli, Terry, Stout & Kraus, LLP

(57) ABSTRACT

A picture image forming apparatus including a photoreceptor belt driven by a drive device, a plurality of developing devices for forming toner picture images on the photoreceptor belt, an intermediate transfer device, to a surface of which toner picture images on the photoreceptor belt are overlappingly transferred plural times when a picture image is to be formed on a single page, and a transfer roller for pushing a sheet against the intermediate transfer device in order to transfer toner picture images to the sheet. The intermediate transfer device is an intermediate transfer belt contacted by the photoreceptor belt to be driven thereby. A photoreceptor-side roller enables contact of the intermediate transfer belt and the photoreceptor belt, and the intermediate transfer belt is trained around the photoreceptor-side roller and a transfer-side roller for pushing the sheet against the transfer roller. A diameter d2 of the transfer-side roller is smaller than a diameter d1 of the photoreceptor-side roller.

12 Claims, 6 Drawing Sheets

PICTURE IMAGE FORMING APPARATUS WITH INTERMEDIATE TRANSFER BELT TRAINED AROUND TWO ROLLERS OF DIFFERENT DIAMETER

FIELD OF THE INVENTION

The invention relates to a picture image forming apparatus, and more particular, to a construction, in which a mechanism for peeling-off a sheet after toner picture images have been transferred to a sheet from an intermediate transfer means is simplified, in a picture image forming apparatus comprising a photoreceptor belt driven by a drive device, developing means for forming toner picture images on the photoreceptor belt, intermediate transfer means, to which toner picture images on the photoreceptor belt are transferred, and a transfer roller for pushing a sheet against the intermediate transfer means in order to transfer toner picture images to the sheet.

BACKGROUND OF THE INVENTION

With respect to a picture image forming apparatus comprising a photoreceptor belt driven by a drive device, a plurality of developing means for forming toner picture images on the photoreceptor belt, an intermediate transfer belt, to a surface of which toner picture images on the photoreceptor belt are transferred plural times when a picture image is to be formed on a single page, and a transfer roller for pushing a sheet against the intermediate transfer belt in order to transfer toner picture images to the sheet, JP-A-11-95517 has proposed a construction with a photoreceptor belt and an intermediate transfer drum.

Also, JP-A-2000-330358 has proposed a picture image forming apparatus comprising an intermediate transfer belt trained around rollers having the same diameter.

In a picture image forming apparatus, in which a plurality of toner picture images are overlapped on a surface of an intermediate transfer means to form a picture image on a single page for multicolored printing, there is a need of an intermediate transfer means having an outer circumference having a length at least equal to or longer than a length of a picture image being printed.

In the case where an intermediate transfer means is formed from a drum as in the prior art described above, a diameter of the drum is large and so curvature at a transfer portion becomes large, so that a sheet and the intermediate transfer means contact with each other in a transfer position, in which toner picture images are transferred to the sheet from the intermediate transfer means, in a wide area in a transfer direction.

Therefore, the sheet is bent to a small extent, and a force for peeling off the sheet from the intermediate transfer means becomes weak, thus giving rise to a need of electricity removing means for assisting peeling-off and including a high-voltage source.

SUMMARY OF THE INVENTION

An object of the invention is to provide a picture image forming apparatus, in which electricity removing means for assisting peeling-off is unnecessary or only a simple electricity removing means is necessary, a sheet can be readily peeled off, an intermediate transfer belt is free from abnormal deformation, and picture images of high image quality are obtained.

The invention proposes a picture image forming apparatus comprising a photoreceptor belt driven by a drive device, a plurality of developing means for forming toner picture images on the photoreceptor belt, intermediate transfer means, to a surface of which toner picture images on the photoreceptor belt are overlappingly transferred plural times when a picture image is to be formed on a single page, and a transfer roller for pushing a sheet against the intermediate transfer means in order to transfer toner picture images to the sheet, and wherein the intermediate transfer means is an intermediate transfer belt contacted by the photoreceptor belt to be driven thereby, and the intermediate transfer belt is trained around a photoreceptor-side roller and a transfer-side roller for pushing the sheet against the transfer roller, and wherein a diameter d2 of the transfer-side roller is smaller than a diameter d1 of the photoreceptor-side roller.

The invention also proposes a picture image forming apparatus comprising a photoreceptor belt driven by a drive device, a plurality of developing means for forming toner picture images on the photoreceptor belt, intermediate transfer means, to a surface of which toner picture images on the photoreceptor belt are overlappingly transferred plural times when a picture image is to be formed on a single page, and a transfer roller for pushing a sheet against the intermediate transfer means in order to transfer toner picture images to the sheet, and wherein the intermediate transfer means is an intermediate transfer belt contacted by the photoreceptor belt to be driven thereby, and the intermediate transfer belt is trained around a photoreceptor-side roller, around which the photoreceptor belt is wound with the intermediate transfer belt therebetween to be rotated, and a transfer-side roller for pushing the sheet against the transfer roller with the intermediate transfer belt therebetween, and wherein a diameter d2 of the transfer-side roller is smaller than a diameter d1 of the photoreceptor-side roller.

In these inventions, the transfer-side roller is small in curvature, and so rigidity of a sheet itself makes it possible to readily peel off the sheet from the intermediate transfer means.

Generally, in the case where the transfer-side roller is made small for the purpose of further improving the peeling-off property, creep deformation is generated in the intermediate transfer belt along the roller. Such deformation causes fluctuation in a gap between the photoreceptor belt and the intermediate transfer belt at a nip between the photoreceptor belt and the intermediate transfer belt and fluctuation in a gap between the intermediate transfer belt and the photoreceptor-side roller, such fluctuation varying a state of transfer, which leads to degradation in image quality.

Hereupon, in the above second invention, the photoreceptor belt is wound around the photoreceptor-side roller with the intermediate transfer belt therebetween, and the photoreceptor belt pushes the intermediate transfer belt concavely against the photoreceptor-side roller. Therefore, even in a state, in which the intermediate transfer belt is deformed convexly toward the photoreceptor belt, the photoreceptor belt and the intermediate transfer belt surely contact with each other, and also the intermediate transfer belt and the photoreceptor-side roller surely contact with each other, so that degradation in image quality is eliminated.

The invention proposes a picture image forming apparatus comprising a photoreceptor belt driven by a drive device, a plurality of developing means for forming toner picture images on the photoreceptor belt, intermediate transfer means, to a surface of which toner picture images on the photoreceptor belt are overlappingly transferred plural times when a picture image is to be formed on a single page, a transfer roller for pushing a sheet against the intermediate transfer means in order to transfer tonner picture images to the sheet, and developing means for melting and fixing toner having been transferred to the sheet, and wherein the intermediate transfer means is an intermediate transfer belt contacted by the photoreceptor belt to be driven thereby, and the intermediate transfer belt is trained around a photoreceptor-side roller and a transfer-side roller for pushing the sheet against the transfer roller, and wherein a diameter d2 of the transfer-side roller is smaller than a diameter d1 of the photoreceptor-side roller, and a point of pressure and fixation on a developing roller of the developing means is disposed nearer the photoreceptor-side than a contact point between the transfer roller and the transfer-side roller is.

Further, the invention proposes a picture image forming apparatus comprising a photoreceptor belt driven by a drive device, a plurality of developing means for forming toner picture images on the photoreceptor belt, intermediate transfer means, to a surface of which toner picture images on the photoreceptor belt are overlappingly transferred plural times when a picture image is to be formed on a single page, a transfer roller for pushing a sheet against the intermediate transfer means in order to transfer tonner picture images to the sheet, and developing means for melting and fixing toner having been transferred to the sheet, and wherein the intermediate transfer means is an intermediate transfer belt contacted by the photoreceptor belt to be driven thereby, and and the intermediate transfer belt is trained around a photoreceptor-side roller, around which the photoreceptor belt is wound with the intermediate transfer belt therebetween to be rotated, and a transfer-side roller for pushing the sheet against the transfer roller with the intermediate transfer belt therebetween, and wherein a diameter d2 of the transfer-side roller is smaller than a diameter d1 of the photoreceptor-side roller, and a point of pressure and fixation on a developing roller of the developing means is disposed nearer the photoreceptor-side than a contact point between the transfer roller and the transfer-side roller is.

In these inventions, since the point of pressure and fixation on the developing roller of the developing means is disposed nearer the photoreceptor-side than the contact point between the transfer roller and the transfer-side roller is, there is obtained an effect of reducing an area where the apparatus is installed, in addition to the effects of the above two inventions.

Other objects, features and advantages of the invention will become apparent from the following description of the embodiments of the invention taken in conjunction with the accompanying drawings.

DETAILED DESCRIPTION OF THE INVENTION

Embodiments of a picture image forming apparatus according to the invention will be described below with reference to FIGS. 1 to 9.

[First Embodiment]

Figure 1:
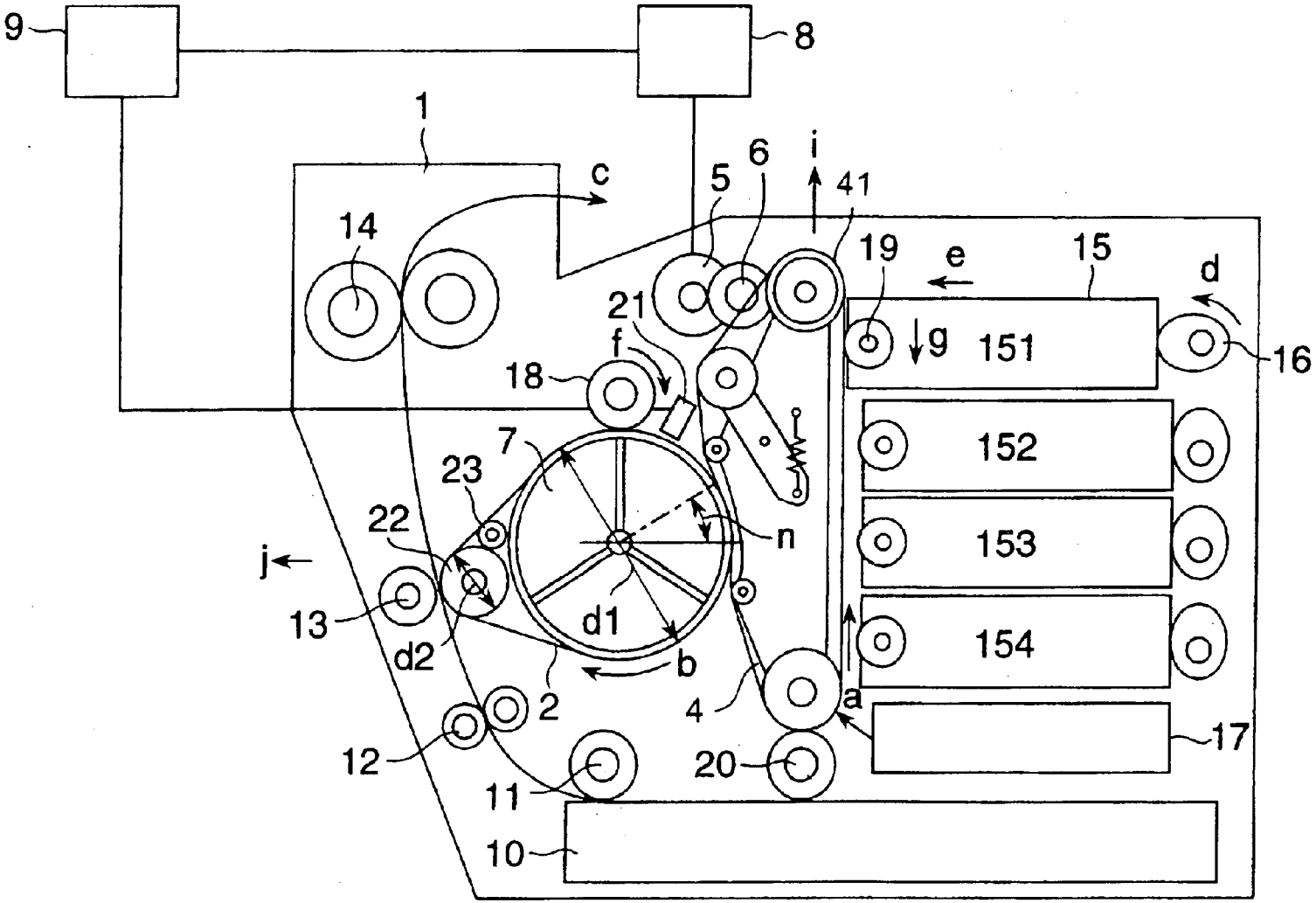
FIG. 1 is a view showing a construction of a first embodiment of a picture image forming apparatus according to the invention.

FIG. 1 is a view showing a construction of a first embodiment of a picture image forming apparatus according to the invention. The picture image forming apparatus according to the first embodiment is a laser printer, in which an intermediate transfer belt 2 makes four revolutions to permit picture images of four colors to be overlapped to form a color picture image. Schematically, a developing unit 15, a photoreceptor belt unit 440, the intermediate transfer belt 2, and a sheet conveying mechanism are arranged in this order from right to left in FIG. 1.

A photoreceptor belt 4 is driven in a direction of an arrow a by a drive roller 41, which is driven via a motor drive system 6 by a drive motor 5. A drive force produced at a nip n put in contact with the photoreceptor belt 4 causes the intermediate transfer belt 2 to be driven by the photoreceptor belt 4.

The photoreceptor belt 4 is one comprising a conductive layer and a photosensitive layer, which are formed on a substrate of a resin such as polycarbonate, polyethylene terephthalate, polyimide or the like. The belt has a thickness of 0.075 to 0.15 mm.

The intermediate transfer belt 2 is a seamless belt formed of a resin such as polycarbonate, polyethylene terephthalate, polyimide or the like, which is processed to be made a semiconductor for transfer of toner and has a volume resistivity of $10^8$ to $10^{11}$ Ω·cm. The belt has a thickness of 0.075 to 0.15 mm.

The intermediate transfer belt 2 is trained around a photoreceptor-side roller 7 and a transfer-side roller 22. The photoreceptor belt a 4 is wound around the photoreceptor-side roller 7 with the intermediate transfer belt 2 therebetween.

The nip n, at which the photoreceptor belt 4 and the intermediate transfer belt 2 contact with each other, is formed above a line, which passes through a center of the photoreceptor-side roller 7 and is in parallel to a surface where the apparatus is installed. This arrangement serves as facilitating mounting and dismounting of the photoreceptor belt unit 40 at the time of maintenance.

The photoreceptor-side roller 7 is of a large diameter to ensure at least 20 mm or more for a width of the nip between it and the photoreceptor belt while the transfer-side roller 22 is of a smaller diameter than that of the photoreceptor-side roller 7. An intermediate transfer belt tension roller 23 is a means for giving tension to the intermediate transfer belt 2, which means uses a spring or the like to push the intermediate transfer belt 2 for tensioning.

The drive motor 5 is controlled by a motor control circuit 8 to be maintained at a predetermined revolving speed. A marker is applied to a surface of the intermediate transfer belt 2 and is sensed by a sensor 21 when passing the sensor. A calculation means 9 reads a signal of such passage to give an instruction to the motor control circuit 8 so that the intermediate transfer belt 2 is driven in a predetermined cycle.

The developing unit 15 serving as a picture image forming means stores toner and forms a thin toner layer on developing rollers 19. When toner picture images are to be formed on the photoreceptor belt 4, retractive means 16 are rotated in a direction of an arrow d to advance the developing unit 15 in a direction e to bring the developing rollers 19 into contact with the photoreceptor belt 4. After formation of picture images, the retractive means 16 are further rotated in the direction of the arrow d for withdrawal of the developing unit 15.

After picture images on the intermediate transfer belt 2 have been transferred to a sheet, a fur brush 18 serving as an erasing means is brought into contact with the intermediate transfer belt 2 by means of retractive means (not shown) to remove the residue of toner, and then is withdrawn.

In addition, while a recording medium, to which toner is finally fixed, is a sheet in the specification of this application, the invention is applicable to a recording medium of other materials such as plastic film or the like.

A transfer roller 13 serving as a transfer means is withdrawn after a retractive means (not shown) presses a sheet against the intermediate transfer belt 2 in the transfer process and the sheet passes the transfer roller 13.

A sheet cassette 10, in which sheets are stored, is arranged in a lower part of the apparatus to be disposed substantially in parallel to the surface where the apparatus is installed. Arranged on a sheet transfer path c are the sheet cassette 10, a pickup roller 11, resist rollers 12, the transfer roller 13, and a fixing device 14. The fixing device 14 is composed of two rollers or a belt being heated to apply heat and pressure on a sheet to melt toner picture images to fix the same to a surface of the sheet.

A process, in which picture images are formed, will be described below.

In order to form picture images, a charging roller 20 charges the photosensitive layer of the photoreceptor belt 4 and laser rays conformed to picture images are irradiated on the photosensitive layer from a laser optical unit 17 to remove electric potential there.

The developing unit 15 brings the developing rollers 19, to which toner adheres, into contact with the photoreceptor belt 4 while rotating the developing rollers, whereby toner layers conformed to picture images are formed on the photoreceptor belt 4. In the first embodiment, in order to form uniform toner picture images, the developing rollers rotate in a direction of an arrow g, that is, the same direction as that, in which the photoreceptor belt 4 moves, and a peripheral speed of the rollers is higher than that, at which the photoreceptor belt 4 moves.

Toner layers on the photoreceptor belt 3 are once transferred to the intermediate transfer belt 2. A color laser printer comprises a black developing unit 151, a yellow developing unit 152, a magenta developing unit 153, and a cyan developing unit 154, and picture images having been formed one color by one color on the photoreceptor belt 3 are overlapped on the intermediate transfer belt 2 to form a colored picture image.

Sheets stored in the sheet cassette 10 are sent out one by one by means of a pickup roller 11 and their skew is corrected by the resist rollers 12. Immediately before a leading end of a sheet reaches an area between the transfer roller 13 and the intermediate transfer belt 2, a retractive means (not shown) pushes the transfer roller 13 against the intermediate transfer belt 2 to thereby press the sheet against the intermediate transfer belt 2. At this time, high voltage is applied on the transfer roller 13 to transfer toner picture images on the intermediate transfer belt 2, onto the sheet. Thereafter, the sheet reaches the fixing device 14, so that the toner picture images on the sheet are fixed with heat and pressure.

The picture images left on the intermediate transfer belt 2 after transfer of the picture image are removed by bringing the fur brush 18 into contact with the intermediate transfer belt 2 and rotating the fur brush. In order to improve the picture image erasing capacity, the fur brush is rotated in a direction of an arrow f opposite to the revolving direction of the intermediate transfer belt 2 in the first embodiment.

Figure 2:
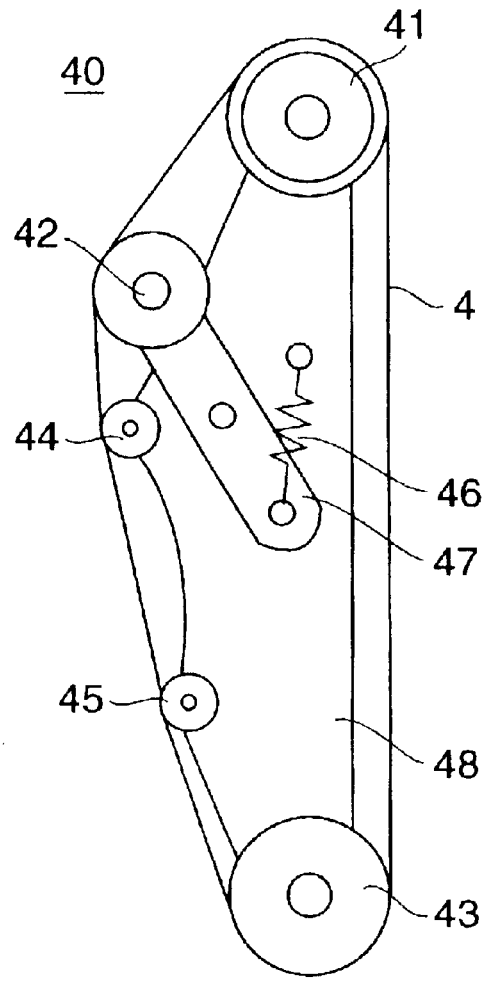
FIG. 2 is a view showing a construction of a photoreceptor belt unit according to the first embodiment.

FIG. 2 is a view showing a construction of the photoreceptor belt unit 40 according to the first embodiment. The photoreceptor belt 4 is trained around a drive roller 41, a photoreceptor belt tension roller 42, and a driven roller 43. A spring 46 and a tension arm 47 cause the photoreceptor belt tension roller 42 to apply tension on the photoreceptor belt 4. A first auxiliary roller 44 and a second auxiliary roller 45 prescribe a width of the nip n between the photoreceptor belt and the intermediate transfer belt 2. These parts are arranged as a photoreceptor belt unit 40 on a photoreceptor belt unit frame 48.

Figure 3:
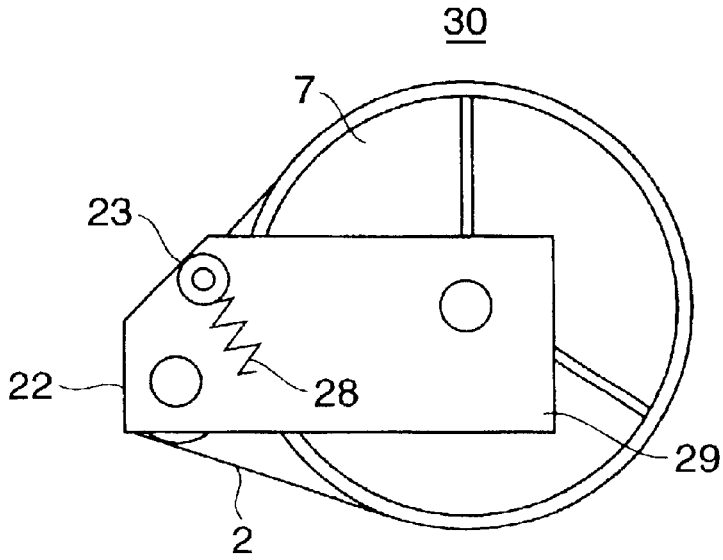
FIG. 3 is a view showing a construction of an intermediate transfer belt unit according to the first embodiment.

FIG. 3 is a view showing a construction of the intermediate transfer belt unit according to the first embodiment. The intermediate transfer belt 2 is trained around the photoreceptor-side roller 7 and the transfer-side roller 22, and given tension by pushing up the intermediate transfer belt tension roller 23 by means of a spring 28. These parts are arranged as an intermediate transfer belt unit 30 on an intermediate transfer belt unit frame 29.

In the first embodiment constructed in the above manner, the intermediate transfer belt 2 is first driven in a driven manner and so no exclusive drive system is necessary, which makes the constitution simple.

Generally, a drive system involves periodic fluctuation in velocity due to eccentricity of a drive roller or the like. It is not possible to make such fluctuation consistent in different drive systems for the photoreceptor belt 4 and the intermediate transfer belt 2, and so difference in velocity will be generated between the photoreceptor belt 4 and the intermediate transfer belt 2. Such difference in velocity leads to color misregistration when picture images are transferred to the intermediate transfer belt 2 from the photoreceptor belt 4.

In contrast, with the driven drive system according to the first embodiment, the above-mentioned influence is not involved, and a high-quality picture image free from color misregistration is obtained.

Also, in order to achieve a stable driven drive with less fluctuation in velocity, it is necessary to ensure a sufficient force of the photoreceptor belt 4 for driving the intermediate transfer belt 2. The drive force is the sum of a drive force given by an electrostatic attracting force between the photoreceptor belt 4 and the intermediate transfer belt 2, and a drive force given by a force, with which tension of the photoreceptor belt 4 causes the photoreceptor belt 4 to push the intermediate transfer belt 2. The respective drive forces are in proportion to a width of the nip between the photoreceptor belt 4 and the intermediate transfer belt 2. Accordingly, in order to obtain a proper drive force, the width of the nip must be made large to be at least 20 mm or larger, or desirably 25 mm or larger.

Subsequently, there are provided the photoreceptor-side roller 7, around which the photoreceptor belt 4 is wound with the intermediate transfer belt 2 therebetween, and the transfer-side roller 22, against which a sheet is pushed with the intermediate transfer belt 2 therebetween, the intermediate transfer belt 2 being trained around the two rollers 7 and 22.

As the result of adopting such construction, the intermediate transfer belt 2 on a transfer side can be made small in curvature, so that a sheet can be peeled off the intermediate transfer belt 2 by virtue of rigidity of the sheet itself. Accordingly, electricity removing means, a high voltage source for actuating the same, and the like are dispensed with, or in the case where electricity removing means is daringly added, even a simple electricity removing brush or the like can peel off a sheet, which makes the constitution simple.

Meanwhile, in the case where the transfer-side roller 22 is made small in diameter in order to improve the peeling-off property, creep deformation will be generated along the roller. Such deformation causes fluctuation in a gap between the photoreceptor belt 4 and the intermediate transfer belt 2 at the nip n between the photoreceptor belt 4 and the intermediate transfer belt 2, and fluctuation in a gap between the intermediate transfer belt 2 and the photoreceptor-side roller 7, such fluctuations varying a state of transfer, which leads to degradation in image quality.

In the case where an arrangement, in which the photoreceptor belt 4 is trained around the photoreceptor-side roller 7 with the intermediate transfer belt 2 therebetween, is adopted as in the first embodiment, the photoreceptor belt 4 pushes the intermediate transfer belt 2 concavely against the photoreceptor-side roller 7 even when the intermediate transfer belt 2 is deformed convexly toward the photoreceptor belt 4. Therefore, the photoreceptor belt 4 and the intermediate transfer belt 2 surely contact with each other, and also the intermediate transfer belt 2 and the photoreceptor-side roller 7 surely contact with each other, so that degradation in image quality is eliminated.

Further, when a diameter d1 of the photoreceptor-side roller 7 is made large relative to a diameter d2 of the transfer-side roller 22, the photoreceptor belt 4 trained around the photoreceptor-side roller 7 at the nip n is decreased in creep deformation, so that no fluctuation in a gap between the developing unit 15 and the photoreceptor belt 4 is generated and a high-quality picture image is obtained. Since creep deformation of the intermediate transfer belt 2 is also decreased at the photoreceptor-side roller 7, the photoreceptor belt 4 and the intermediate transfer belt 2 surely contact with each other, and the intermediate transfer belt 2 and the photoreceptor-side roller 7 surely contact with each other, so that degradation in image quality is eliminated. Also, a width of the nip for achieving a stable driven drive of the intermediate transfer belt 2 can be easily ensured.

Taking account of making creep deformation as small as possible as well as ensuring a sufficient peeling-off property, the transfer-side roller 22 preferably has a diameter of 20 to 30 mm. Also, in order to be able to decrease creep deformation and ensure a width of the nip n, the photoreceptor-side roller 7 preferably has a diameter of 40 mm or more. A diameter of the photoreceptor-side roller 7 is essentially prescribed by a maximum processible sheet size such as A4, B4, A3 and so on. Such diameter is preferably 100 mm or more in order to shorten a distance between the rotating shafts for reduction of an area where the picture image forming apparatus 1 is installed.

Subsequently, the provision of the means for giving tension to the intermediate transfer belt 2 makes it possible to decrease deformation of the intermediate transfer belt 2 at the nip n between the photoreceptor belt 4 and the intermediate transfer belt 2 and degradation in image quality, caused by fluctuation in the gap therebetween even when creep deformation is generated.

The nip n, at which the photoreceptor belt 3 and the intermediate transfer belt 2 contact with each other, is formed above the line, which passes through the center of the photoreceptor-side roller 7 and is in parallel to the surface where the apparatus is installed, whereby mounting and dismounting of the photoreceptor belt unit 4 in a direction i upwardly of the apparatus are made possible to facilitate maintenance of the photoreceptor belt unit 40.

In addition, since the transfer-side roller 22 is arranged on a opposite side of the photoreceptor belt 3 relative to the rotating shaft of the photoreceptor-side roller 7, the intermediate transfer belt unit 30 can be easily mounted and dismounted in a horizontal direction j.

[Second Embodiment]

Figure 4:
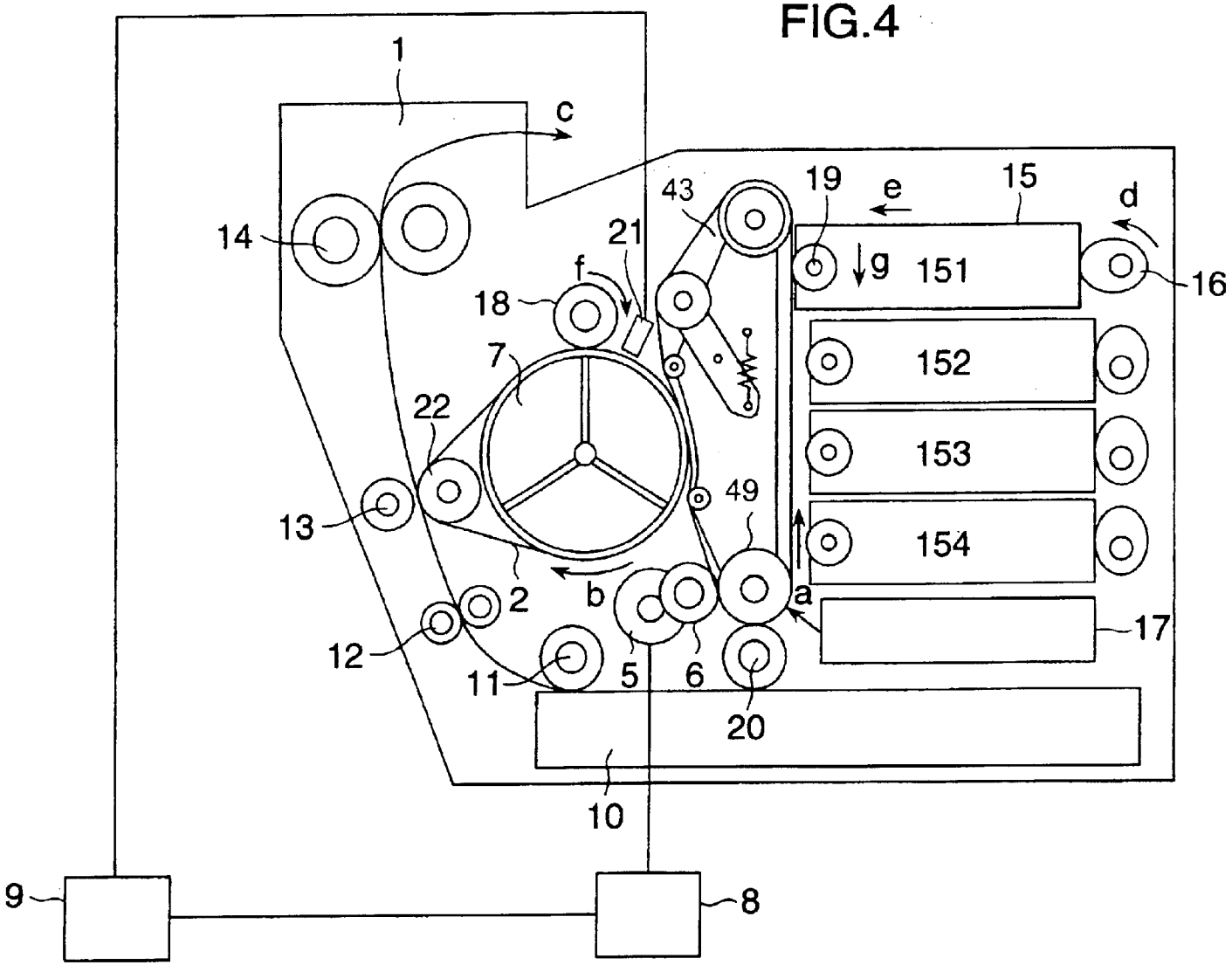
FIG. 4 is a view showing a construction of a second embodiment of a picture image forming apparatus according to the invention.

FIG. 4 is a view showing a construction of a second embodiment of a picture image forming apparatus according to the invention. The second embodiment is different from the first embodiment in that a drive roller 49 for the photoreceptor belt 4 is disposed in an exposure position in a lower part of the apparatus.

In the case of being driven in other positions than the exposure position, the photoreceptor belt 4 and/or the intermediate transfer belt 2 undergoes lengthening and shrinking when load fluctuation due to contact by the fur brush 18 or the like is caused, whereby the exposure position is varied. When the drive roller 49 is disposed in the exposure position, variation due to lengthening and shrinking of the photoreceptor belt 4 and/or the intermediate transfer belt 2 disappears, so that image quality is improved.

Also, since only the addition of a single gear to the motor drive system 6 for the photoreceptor belt 4 enables constituting a drive system for rotating the charging roller 20, the apparatus is made simple in construction.

Further, the tension roller 23 for giving tension to the intermediate transfer belt 2 is removed. When the photoreceptor-side roller 7 has a large diameter relative to that of the transfer-side roller 22, the intermediate transfer belt 2 is trained over an extent of 180 degrees or more around the photoreceptor-side roller 7.

Accordingly, even without application of tension, the intermediate transfer belt 2 is surely wound around the photoreceptor-side roller 7 to eliminate fluttering at the nip n, so that image quality is made stable with a further simple constitution. For higher stabilization, it is desired that a ratio of a diameter of the transfer-side roller 22 to a diameter of the photoreceptor-side roller 7 be 1:3 or higher.

[Third Embodiment]

Figure 5:
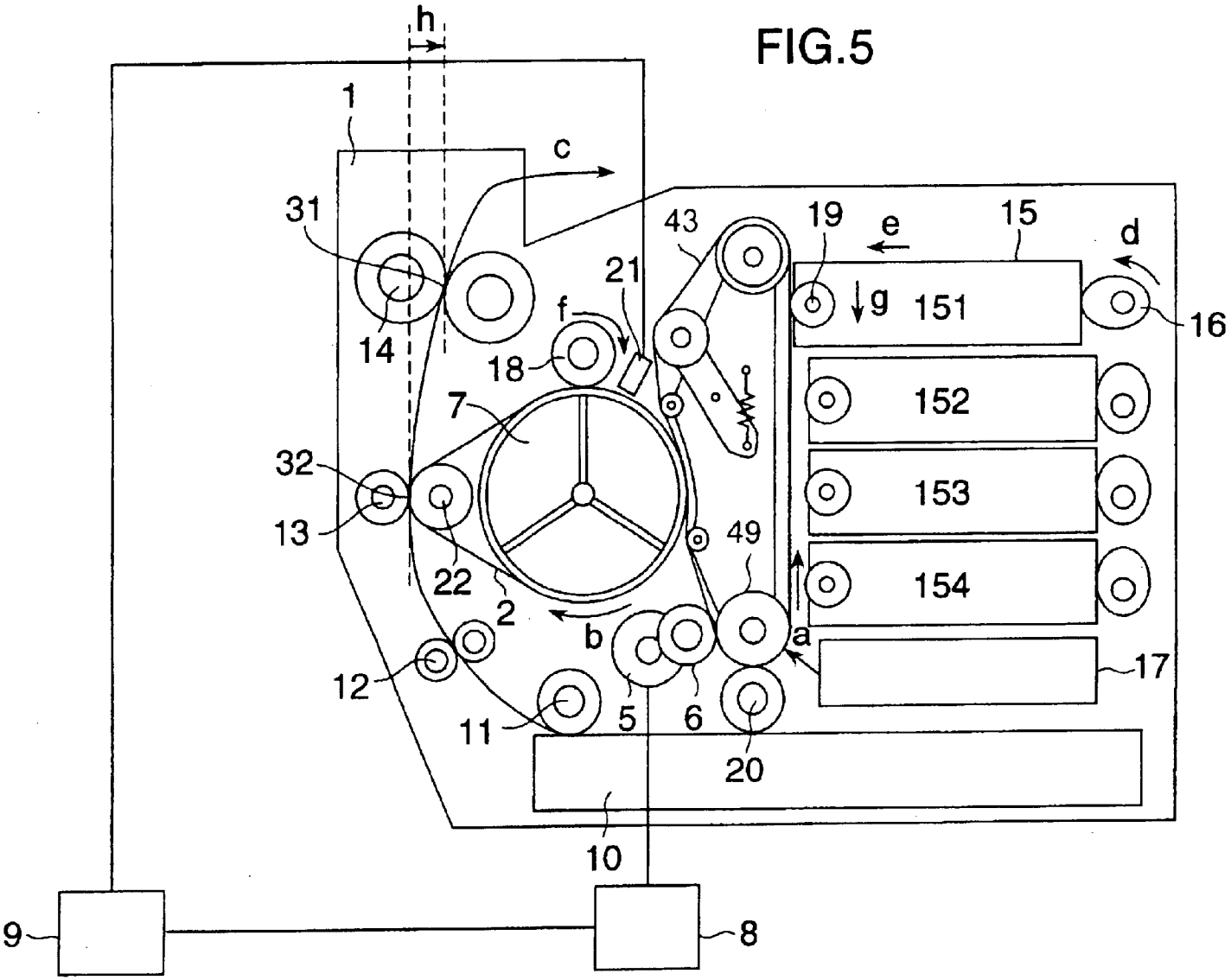
FIG. 5 is a view showing a construction of a third embodiment of a picture image forming apparatus according to the invention.

FIG. 5 is a view showing a construction of a third embodiment of a picture image forming apparatus according to the invention. The third embodiment is different from the second embodiment in that a rotating shaft of the photoreceptor-side roller 7 and a rotating shaft of the transfer-side roller 22 are disposed substantially horizontal. Also, a sheet transfer position 31 on the fixing device 14 is disposed a distance h toward a photoreceptor side relative to a sheet transfer position 32 defined by the transfer roller 13 and the intermediate transfer belt 2.

Conventionally, such transfer path has called for electricity removing and peeling-off means of relatively high capacity in peeling off a sheet because gravity of a sheet cannot be made use of in peeling-off and an electrostatic force is liable to act by virtue of a sheet itself being conveyed along the intermediate transfer means and a spacing between a sheet after transfer and the intermediate transfer means being small.

When the intermediate transfer means is formed from the belt 2 and the transfer-side roller 22 has a small diameter as in the third embodiment, the peeling-off capacity is increased, so that with the above transfer path, electricity removing means is made unnecessary, or simple means such as an electricity removing brush suffices.

According to the third embodiment, the fixing device 14 is disposed toward the photoreceptor side to enable reducing an area where the apparatus is installed, and so the area where the apparatus is installed can approximate to a projected area of the sheet cassette 10.

Figure 6:
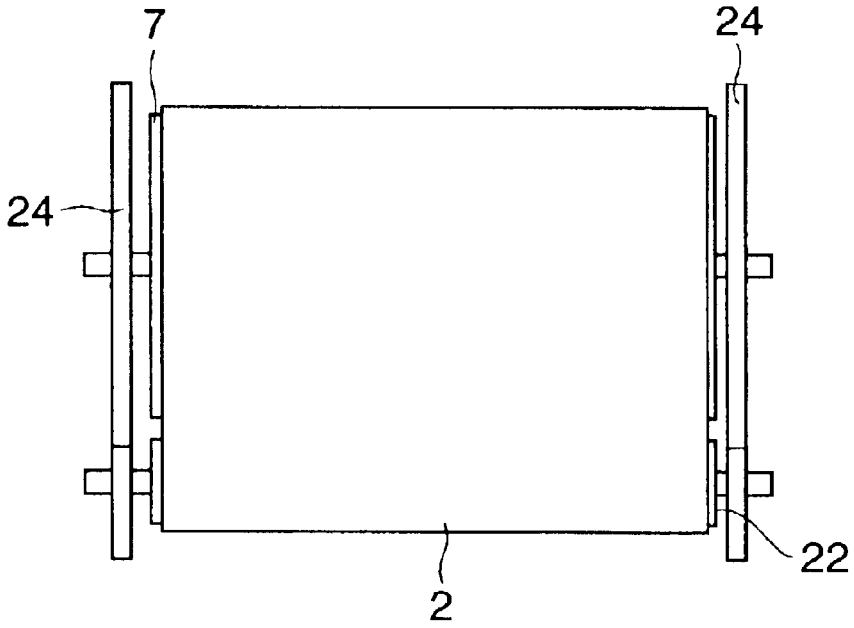
FIG. 6 is a plan view showing a first embodiment of an intermediate transfer belt offset preventing mechanism in a picture image forming apparatus according to the invention.
Figure 7:
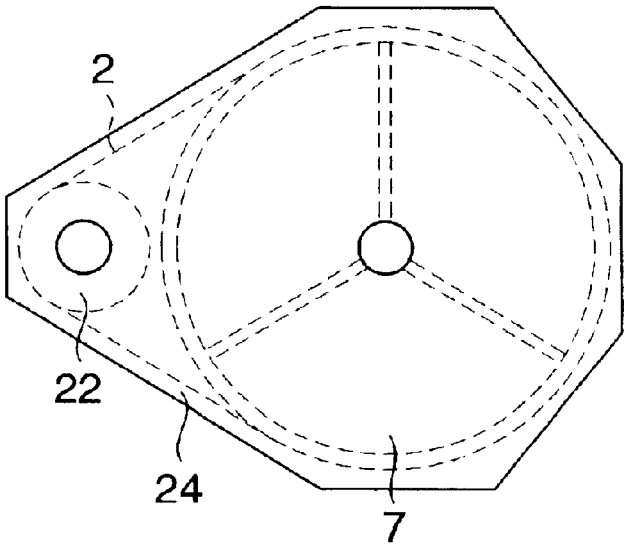
FIG. 7 is a side view showing a first embodiment of an intermediate transfer belt offset preventing mechanism in a picture image forming apparatus according to the invention.

FIG. 6 is a plan view showing one example of an intermediate transfer belt offset preventing mechanism in the picture image forming apparatus according to the invention, and FIG. 7 is a side view showing the example of the intermediate transfer belt offset preventing mechanism.

In the example, when the intermediate transfer belt 2 becomes offset, its end is caused to abut against a side plate 24 to be stopped. A substantially entire circumference of the end of the intermediate transfer belt 2 is made to abut uniformly against the side plate 24 whereby contact pressure at the end is decreased and so damage on the end is prevented.

Also, since the intermediate transfer belt 2 is trained around the combination of the large roller 7 and the small roller 22, straight portions of the belt are shortened, and so the ends of the belt will not buckle even when the intermediate transfer belt 2 becomes severely offset.

Figure 8:
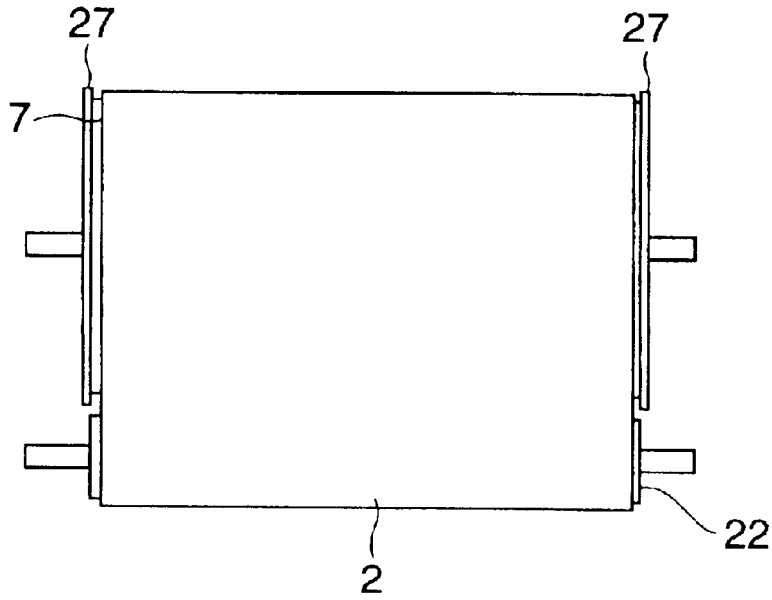
FIG. 8 is a side view showing a second embodiment of an intermediate transfer belt offset preventing mechanism in a picture image forming apparatus according to the invention.
Figure 9:
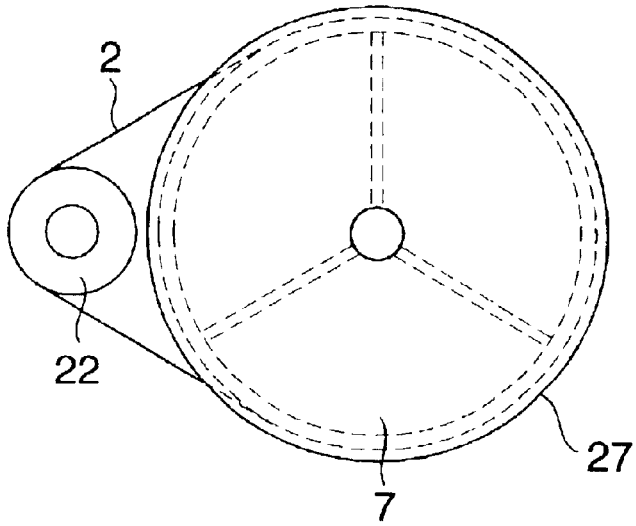
FIG. 9 is a side view showing the second embodiment of the intermediate transfer belt offset preventing mechanism in the picture image forming apparatus according to the invention.

FIG. 8 is a plan view showing a another example of an intermediate transfer belt offset preventing mechanism in the picture image forming apparatus according to the invention, and FIG. 9 is a side view showing the another example of the intermediate transfer belt offset preventing mechanism.

In the another example, when the intermediate transfer belt 2 becomes offset, its end is caused to abut against a flange 27 of a roller 7 toward the intermediate transfer belt 2 to be stopped. When the flanges 27 are provided on the roller 7 having a large diameter and a lengthy outer periphery, a semicircle or more of an end of the intermediate transfer belt 2 abuts against the flange 27 when the intermediate transfer belt 2 becomes offset, whereby contact pressure at the end is decreased and so damage on the end is prevented.

Also, when the flanges 27 are rotated together with the roller 7, it is possible to decrease load when the end of the intermediate transfer belt 2 contacts with the flange 27. Accordingly, the intermediate transfer belt 2 is driven stably to enhance accuracy of color registration and improve image quality.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A picture image forming apparatus comprising a photoreceptor belt driven by a drive device, a plurality of developing means for forming toner picture images on the photoreceptor belt, intermediate transfer means, to a surface of which toner picture images on the photoreceptor belt are overlappingly transferred plural times when a picture image is to be formed on a single page, and a transfer roller for pushing a sheet against the intermediate transfer means in order to transfer toner picture images to the sheet, and wherein the intermediate transfer means is an intermediate transfer belt contacted by the photoreceptor belt to be driven thereby, a photoreceptor-side roller enables contact of the intermediate transfer belt and the photoreceptor belt, and the intermediate transfer belt is trained around the photoreceptor-side roller and a transfer-side roller for pushing the sheet against the transfer roller, and wherein a diameter d2 of the transfer-side roller is smaller than a diameter d1 of the photoreceptor-side roller.

2. A picture image forming apparatus comprising a photoreceptor belt driven by a drive device, a plurality of developing means for forming toner picture images on the photoreceptor belt, intermediate transfer means, to a surface of which toner picture images on the photoreceptor belt are overlappingly transferred plural times when a picture image on a single page is to be formed, and a transfer roller for pushing a sheet against the intermediate transfer means in order to transfer toner picture images to the sheet, and wherein the intermediate transfer means is an intermediate transfer belt contacted by the photoreceptor belt to be driven thereby, a photoreceptor-side roller enables contact of the intermediate transfer belt and the photoreceptor belt, and the intermediate transfer belt is trained around the photoreceptor-side roller, around which the photoreceptor belt is wound with the intermediate transfer belt therebetween to be rotated, and a transfer-side roller for pushing the sheet against the transfer roller with the intermediate transfer belt therebetween, and wherein a diameter d2 of the transfer-side roller is smaller than a diameter d1 of the photoreceptor-side roller.

3. A picture image forming apparatus comprising a photoreceptor belt driven by a drive device, a plurality of developing means for forming toner picture images on the photoreceptor belt, intermediate transfer means, to a surface of which toner picture images on the photoreceptor belt are overlappingly transferred plural times when a picture image is to be formed on a single page, a transfer roller for pushing a sheet against the intermediate transfer means in order to transfer toner picture images to the sheet, and developing means for melting and fixing toner transferred to the sheet, and wherein the intermediate transfer means is an intermediate transfer belt contacted by the photoreceptor belt to be driven thereby, a photoreceptor-side roller enables contact of the intermediate transfer belt and the photoreceptor belt, and the intermediate transfer belt is trained around a-the-photoreceptor-side roller and a transfer-side roller for pushing the sheet against the transfer roller, and wherein a diameter d2 of the transfer-side roller is smaller than a diameter d1 of the photoreceptor-side roller, and a point of pressure and fixation on a developing roller of the developing means is disposed nearer the photoreceptor side than a contact point between the transfer roller and the transfer-side roller is.

4. A picture image forming apparatus comprising a photoreceptor belt driven by a drive device, a plurality of developing means for forming toner picture images on the photoreceptor belt, intermediate transfer means, to a surface of which toner picture images on the photoreceptor belt are overlappingly transferred plural times when a picture image is to be formed on a single page, a transfer roller for pushing a sheet against the intermediate transfer means in order to transfer toner picture images to the sheet, and developing means for melting and fixing toner transferred to the sheet, and wherein the intermediate transfer means is an intermediate transfer belt contacted by the photoreceptor belt to be driven thereby, a photoreceptor-side roller enables contact of the intermediate transfer belt and the photoreceptor belt, and the intermediate transfer belt is trained around the photoreceptor-side roller, around which the photoreceptor belt is wound with the intermediate transfer belt therebetween to be rotated, and a transfer-side roller for pushing the sheet against the transfer roller with the intermediate transfer belt therebetween, and wherein a diameter d2 of the transfer-side roller is smaller than a diameter d1 of the photoreceptor-side roller, and a point of pressure and fixation on a developing roller of the developing means is disposed nearer the photoreceptor-side than a contact point between the transfer roller and the transfer-side roller is.

5. The picture image forming apparatus according to any one of claims 1 to 4, wherein the diameter d2 of the transfer-side roller is 20 mm to 30 mm.

6. The picture image forming apparatus according to any one of claims 1 to 4, wherein the diameter d1 of the photoreceptor-side roller is 40 mm or more.

7. The picture image forming apparatus according to any one of claims 1 to 4, further comprising means for giving tension to the intermediate transfer belt.

8. The picture image forming apparatus according to claim 5, wherein the diameter d1 of the photoreceptor-side roller is 40 mm or more.

9. The picture image forming apparatus according to claim 5, further comprising means for giving tension to the intermediate transfer belt.

10. The picture image forming apparatus according to claim 6, further comprising means for giving tension to the intermediate transfer belt.

11. The picture image forming apparatus according to any one of claims 1 to 4, wherein a ratio of the diameter d2 of the transfer-side roller to the diameter d1 of the transfer-side roller is at least 1:3.

12. The picture image forming apparatus according to any one of claims 1 to 4, wherein a surface of the photoreceptor-side roller is positioned closer to a point of contact of the intermediate transfer belt and the photoreceptor belt than any other roller around which the intermediate transfer belt is trained.

* * * * *